US005476189A

United States Patent [19]

Duvall et al.

[11] Patent Number: 5,476,189

[45] Date of Patent: Dec. 19, 1995

[54] PRESSURE VESSEL WITH DAMAGE MITIGATING SYSTEM

[76] Inventors: Paul F. Duvall; Ayodeji J. Avorinde; Alvin R. Cederberg, all c/o Brunswick Corporation, 4300 Industrial Ave., Lincoln, Nebr. 68504

[21] Appl. No.: 161,919

[22] Filed: Dec. 3, 1993

[51] Int. Cl.[6] ..... F17C 1/06

[52] U.S. Cl. ..... 220/590; 220/589; 220/588; 220/414; 220/437; 220/446; 220/448; 220/461; 220/465; 220/667

[58] Field of Search ..... 220/586, 588, 220/589, 590, 591, 592, 414, 429, 437, 444, 445, 446, 447, 448, 452, 461, 465, 466, 667, 900

[56] References Cited

U.S. PATENT DOCUMENTS 3,787,279 1/1974 Winchester ..... 220/461 X
3,904,068 9/1975 Beaujean ..... 220/444
3,927,788 12/1975 Zinniger et al. ..... 220/437 X
4,871,078 10/1989 Sharp ..... 220/444 X

*Primary Examiner*—Stephen P. Garbe
*Assistant Examiner*—Stephen Cronin
*Attorney, Agent, or Firm*—John R. Hoffman

[57] ABSTRACT

A pressure vessel is disclosed for holding fluids and the like. The vessel includes an outer shell fabricated of a composite material. A damage mitigating material is integrated within the outer shell, with a major thickness of the shell being disposed inside the damage mitigating material and a minor thickness of the shell being disposed outside the damage mitigating material. The minor thickness of the shell and the damage mitigating material are physically alterable or deformable upon impact by a given exterior force which may be insufficient to affect the major thickness of the shell.

18 Claims, 1 Drawing Sheet

PRESSURE VESSEL WITH DAMAGE MITIGATING SYSTEM

FIELD OF THE INVENTION

This invention generally relates to the art of pressure vessels and, particularly, to a damage mitigating system which improves impact resistance and enables visual observation of potential interior damage to the vessel.

BACKGROUND OF THE INVENTION

In many applications, the qualities of lightweight construction and high resistance to fragmentation and corrosion damage are highly desirable characteristics for a pressure vessel. These design criteria have been met for many years by the development of high pressure composite (fiber reinforced resin matrix) containers; for instance, containers fabricated of laminated layers of wound fiberglass filaments or various types of other synthetic filaments which are bonded together by a thermal-setting or thermoplastic resin. An elastomeric or other non-metal resilient liner or bladder often is disposed within the composite shell to seal the vessel and prevent internal fluids from contacting the composite material.

Such composite vessels have become commonly used for containing a variety of fluids under pressure, such as storing oxygen, natural gas, nitrogen, rocket or other fuel, propane, etc. The composite construction of the vessels provides numerous advantages such as lightness in weight and resistance to corrosion, fatigue and catastrophic failure. These attributes are due to the high specific strengths of the reinforcing fibers or filaments which typically are oriented in the direction of the principal forces in the construction of the pressure vessels.

Composite pressure vessels of the character described above originally were developed for aircraft and aerospace applications primarily because of the critical weight restrictions in such vehicles. These applications provided a relatively safe environment in which damage to the vessels could be minimized and, in fact, impact damage from extraneous, unintended collisions rarely occurred. However, the growing use of composite pressure vessels in general commercial applications has significantly increased the potential for the vessels to be subjected to uncontrolled damage which may significantly affect the strength of a vessel without showing any obvious visual damage. For instance, during shipment or other handling, a vessel may be dropped and suffer interior or structural damage which is visually undetectable when observing the exterior or shell of the vessel. A damaged vessel might be installed for its intended or ultimate use without anyone even knowing that the vessel was damaged.

Some contemporary approaches to solving these problems have included increasing the shell or wall thicknesses of the vessels, using sacrificial material on the exterior surfaces of the vessels and applying rubber or other elastomer coatings to the vessels. Such systems actually involve adding some sort of protective feature to the surface of the vessels after the vessels have been primarily constructed. They function more to prevent damage to the vessels rather than provide visual evidence that damage may have occurred. In addition, these expedients which involve adding extraneous materials to the outside of the vessels can and do increase the overall size and weight of the vessels. Increasing the composite wall thickness of a vessel to prevent damage thereto simply defeats the purpose of providing a lightweight structure. Adding sacrificial material, such as a layer of fiberglass over an entire vessel so that the layer is cut, gouged or punctured without changing the integrity of the composite shell of the tank, again simply is adding an additional thickness to the vessel itself. The same disadvantages apply to the use of rubber or other elastomer coatings to a vessel, and such coatings are significantly heavier than the same thickness of a composite material. All of these expedients also have the disadvantage of potentially obscuring the damage which they are intended to prevent, just contrary to the concepts of the present invention as disclosed and claimed herein. In other words, a damage-preventing external coating or cover that does not sustain visually obvious surface damage provides no evidence to an inspector that a damage-inducing event has occurred, even though structural damage may have been sustained by the primary composite structure beneath the area of impact.

The present invention is directed to solving the above problems and mitigating the results of impact damage by making serious damage easy to visually detect while not changing the appearance of the vessel in any other respect.

SUMMARY OF THE INVENTION

An object, therefore, of the invention is to provide a damage mitigating system in hollow vessels, such as pressure vessels. The invention is particularly applicable for composite pressure vessels, such as filament wound vessels.

In the exemplary embodiment of the invention, a pressure vessel is disclosed with an outer shell fabricated of composite material. An inner, generally fluid impervious liner may be disposed in the outer shell generally against the inside surface thereof. The invention contemplates that a damage mitigating material be integrated within the outer shell. In the specific embodiment disclosed, a major thickness of the shell is disposed inside the damage mitigating material, and a minor thickness of the shell is disposed outside the damage mitigating material. The minor thickness and the damage mitigating material are physically alterable upon impact by a given exterior force which may be insufficient to affect the major thickness of the shell.

The invention is disclosed in the preferred embodiment by employing a damage mitigating material which is crushable, such as a rigid closed cell foam material. The vessel is elongated, with at least one dome-shaped end, and the damage mitigating material is integrated in the outer shell only in the area of the dome-shaped end. This limited area still is quite effective because such an elongated vessel, when dropped, normally will land on one of its ends and/or bounce back and forth between its ends.

More generally, the system of the invention is provided for detecting potential damage to a generally hollow vessel which is fabricated of composite material. The vessel includes an outer shell within which is integrated a damage mitigating material. A given thickness of the composite shell, such as a lamination of filament windings, is disposed outside the damage mitigating material. That given thickness of the composite shell and the damage mitigating material are deformable upon impact by a given exterior force.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
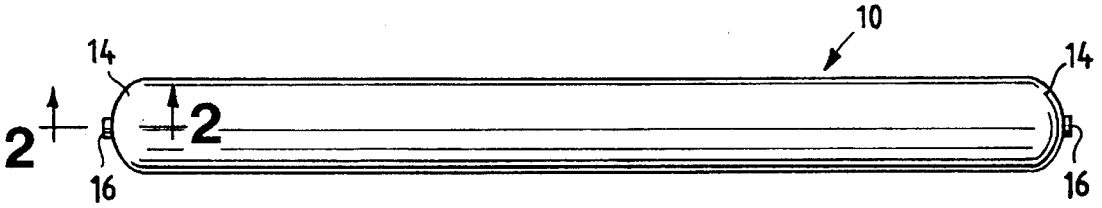
FIG. 1 is a side elevational view of a typical elongated pressure vessel with which the invention may be applicable.

Referring to the drawings in greater detail, FIG. 1 shows a typical pressure vessel, generally designated 10, for holding fluids or the like. The vessel is considerably elongated and includes a main body section 12 of a generally cylindrical configuration and a pair of end sections 14 of generally hemispheroidal configurations. Bosses 16 may be provided at one or both ends of the vessel to provide one or two ports communicating with the interior of the vessel. The exterior of the vessel is formed by an outer composite shell, generally designated 18. By "composite" is meant a fiber reinforced resin matrix material, such as a filament wound or laminated structure.

Figure 2:
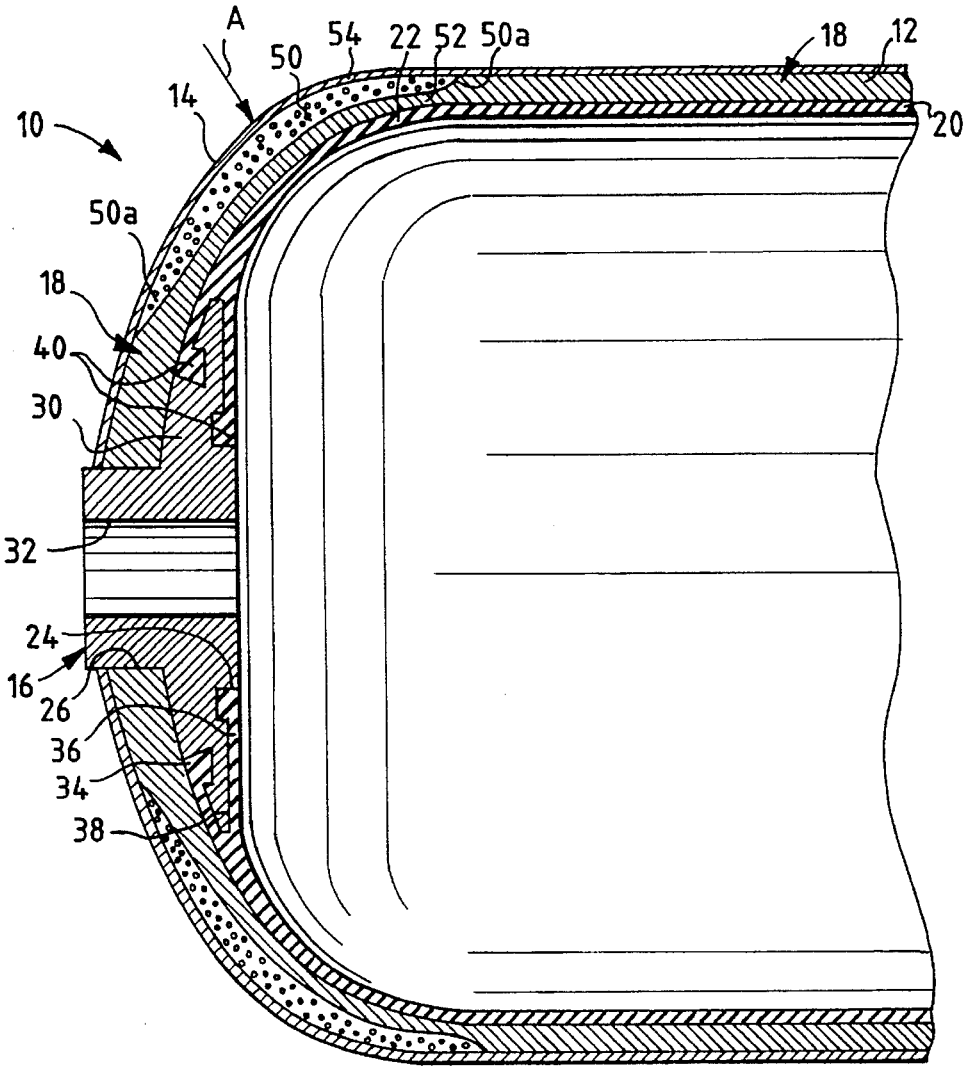
FIG. 2 is a fragmented axial section through one end of such a pressure vessel and incorporating an embodiment of the invention.

FIG. 2 shows an axial section through one hemispheroidal end 14 of the pressure vessel, such as if taken generally along line 2—2 of FIG. 1. It can be seen that the pressure vessel in FIG. 2 includes outer shell 18 and boss 16, as well as an inner liner 20 having a generally hemispheroidal end section 22 with an opening 24 aligned with an opening 26 in outer shell 18. Boss 16 is positioned within the aligned openings and includes a neck portion 28 and a radially outwardly projecting flange portion 30. The boss defines a port 32 through which fluid at high pressure may be communicated with the interior of pressure vessel 10. Inner liner 20 includes a dual-layer lip circumscribing opening 24 in the liner, with an outer lip segment 34 and an inner lip segment 36 defining an annular recess 38 therebetween for receiving flange portion 30 of boss 16. Dovetailed interengaging locking means 40 are provided between flange portion 30 and outer and inner lip segments 34 and 36, respectively, to lock inner liner 20 to boss 16.

Outer shell 18 is a composite shell fabricated of a substantially rigid, mechanically strong material such as fiber reinforcing material in a resin matrix. The fiber may be fiberglass, ARAMID, carbon, graphite, or any other generally known fibrous reinforcing material. The resin matrix may be epoxy, polyester, vinylester, thermoplastic or any other suitable resinous material capable of providing the properties required for the particular application in which the vessel is to be used.

Inner liner 20 is a generally fluid impervious flexible liner disposed in outer shell 18 against the inside surface thereof. The inner liner may be made of plastic or other elastomers and can be manufactured by compression molding, blow molding, injection molding or any other generally known technique. Boss 16 may be composed of an alloy of aluminum, steel, nickel or titanium, although it is understood that other metal and nonmetal materials, such as composite materials, are suitable.

As elaborated upon in the "Background", above, the present invention is directed to a damage mitigating system wherein a material is incorporated in the pressure vessel so that potential structural damage to the vessel can be minimized and detected. Generally, the invention contemplates integrating a damage mitigating material or element into the design of the composite shell 18 of pressure vessel 10, which will deform under localized impact. The preferred embodiment contemplates that the material or element be integrated directly into the composite structure of the vessel.

More particularly, as seen in FIG. 2, a damage mitigating material or element 50 is integrated outside a primary composite structure 52 and inside an outer structure 54. Primary composite structure 52 can be considered as a major thickness of shell 18, and outer composite structure 54 can be considered a minor thickness of shell 18. The cross-hatching in the drawings depict major thickness 52 and minor thickness 54 to be separate structural or layered components. However, in actual practice, shell 18 most likely is a homogeneous structure beyond ends 50*a* of damage mitigating material 50. For instance, if shell 18 is fabricated of filament wound composite material, a minor thickness of windings would comprise minor thickness 54 outside damage mitigating material 50, but the shell beyond the ends of the mitigating material would be a homogeneously cured structure simply continuing from major thickness 52. Similarly, if the shell is laid up of layers of fibrous fabric in a matrix, again there simply would be a thinner layer of the structural composite outside the damage mitigating material versus the inside thereof, but the shell would be a homogeneously cured structure beyond the bounds of the damage mitigating material. If the shell is molded or cast of fibrous composite material, the same structural characteristics apply.

In the preferred embodiment of the invention, damage mitigating material or element 50 is a rigid closed cell foam material. It may be a polyurethane structural foam. However, the damage mitigating material or element may be made of a wide variety of materials, including but not limited to thermoplastics, thermosets, organic or inorganic fibers, rubber, metals, papers, glass, open or closed cell foams, woven or random fiber pads, prefabricated core structures such as honeycombs, and the like. All of these materials, such as the preferred rigid foam material, will have a characteristic that they deform or crush under localized loading. All of the materials, whether restorable or permanently deformable, are physically alterable upon impact by a given exterior force.

Therefore, if vessel 10 in FIG. 2 was subjected to a given impact force in the direction of arrow "A", minor thickness 54 of shell 18 and damage mitigating material 50 will crush or deform inwardly. This will leave a dent, perforation, crack or discoloration in the outside surface of the vessel to give a visual indication to an observer that there may be potential structural damage to the interior of the vessel. Even if damage mitigating material 50 is a "restorable" material, such as a rubber or similar elastomer, outer thickness 54 would deform and visually indicate a potential damage. The vessel then can be discarded or further inspected for actual damage, with the result that material 50 has fulfilled its mitigating function.

It was described above that inner thickness 52 is a "major" thickness and outer thickness 54 is a "minor" thickness. These relative thicknesses are preferred when it is desired that the exterior of the vessel become "dented" or crushed under a given range of localized loading or impact which is insufficient to actually damage the major thickness of the composite shell. This relationship is preferred when it is desired that the occurrence of impact on the vessel is easily detectable in situations where the vessel actually may be full of a particular substance, and it is highly desirable to inspect the vessel to assess safety whenever the vessel is subjected to any impacts. However, the invention contemplates that this relative thickness relationship is not limiting.

In addition, damage mitigating material or element 50 can be localized to the end or ends of a vessel as shown in FIG. 2, or it may cover any other portion or all of the vessel. It is shown localized in the end of the vessel herein, because vessel 10 is considerably elongated and, when dropped, the vessel invariably will be impacted at its ends. It also is contemplated that the damage mitigating element can be variable or it can be uniform in thickness and density, and the element may have properties which are uniform or vary over the surface of the vessel.

Still further, in the preferred embodiment, damage mitigating element 50 is covered with composite layers which provide an external shell or outside thickness 54 over the damage mitigating element, as described above. This fully integrates the damage mitigating element within the structural shell of the vessel and results in a vessel structure which has the external appearance of a conventionally designed composite pressure vessel. The external shell provides protection against low level impacts, cutting, abrasion, chemical exposure, localized heating, weathering and deterioration due to ultraviolet radiation.

In summation, the damage mitigating system of the invention provides a means of increasing the damage resistance of the vessel and indicating vessel exposure to damage-inducing environments. Localized impact, such as may occur if the vessel is dropped or struck, will cause localized deformation of the outer shell 54 or surface of the vessel. Damage mitigating element 50 will deform or crush under the point of impact to absorb the energy of the impact, mitigate the peak load and distribute the induced load over an enlarged area. Thus, the damage mitigating element provides a protective function, particularly with such materials as rigid foams or honeycomb structures. The visually detectable permanent effects of the impact on the outside of the shell may be denting, perforation, cracking or discoloration. Outside thickness 54 may be designed to provide witness to different levels of impact. Impacts which would not induce severe damage to the major thickness of the shell may not cause permanent indications in the outside minor thickness. More severe impacts which would be damaging to the major structural thickness may also cause permanent visually detectable to the outside or minor thickness.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

we claim:

1. A pressure vessel for holding fluids, comprising:

an outer shell fabricated of a homogeneous fibrous composite material;

an inner, generally fluid impervious liner disposed in the outer shell generally against the inside surface thereof; and a damage mitigating material integrated within the outer shell with a major thickness of the homogeneous fibrous shell being disposed inside the damage mitigating material and a minor thickness of the homogeneous fibrous shell being disposed outside the damage mitigating material so that the damage mitigating material is entrapped by the homogeneous fibrous composite material, the minor thickness and the damage mitigating material being physically alterable upon impact by a given exterior force which may be insufficient to affect the major thickness of the shell.

2. The pressure vessel of claim 1 wherein said damage mitigating material comprises a crushable material.

3. The pressure vessel of claim 2 wherein said damage mitigating material comprises a rigid foam material.

4. The pressure vessel of claim 1 wherein said vessel is elongated with at least one hemispherical end, and said damage mitigating material is integrated in the outer shell only in the area of said end.

5. A generally hollow vessel for holding fluids comprising:

an outer shell fabricated of filament wound composite material; and a damage mitigating material integrated within the outer shell with a major thickness of the shell being disposed inside the damage mitigating material and a minor thickness of the shell being disposed outside the damage mitigating material, the minor thickness and the damage mitigating material being physically alterable upon impact by a given exterior force which may be insufficient to affect the major thickness of the shell.

6. The vessel of claim 5 wherein said damage mitigating material comprises a crushable material.

7. The vessel of claim 6 wherein said damage mitigating material comprises a rigid foam material.

8. The vessel of claim 5 wherein said vessel is elongated with at least one hemispherical end, and said damage mitigating material is integrated in the outer shell only in the area of said end.

9. A system for mitigating potential damage to a generally hollow pressure vessel which is fabricated of composite material, the vessel including an outer shell fabricated of a homogeneous fibrous composite material within which is entrapped a damage mitigating material, with a given thickness of the homogeneous fibrous composite shell being disposed outside the damage mitigating material, said given thickness of the composite shell and the damage mitigating material being deformable upon impact by a given exterior force.

10. The system of claim 9 wherein said damage mitigating material comprises a crushable material.

11. The system of claim 10 wherein said damage mitigating material comprises a rigid foam material.

12. The system of claim 9 wherein said vessel is elongated with at least one hemispherical end, and said damage mitigating material is integrated in the outer shell only in the area of said end.

13. A pressure vessel for holding fluids, comprising:

an outer shell fabricated of filament wound composite material;

an inner, generally fluid impervious liner disposed in the outer shell generally against the inside surface thereof; and a damage mitigating material integrated within the outer shell with a major thickness of the shell being disposed inside the damage mitigating material and a minor thickness of the shell being disposed outside the damage mitigating material, the minor thickness and the damage mitigating material being physically alterable upon impact by a given exterior force which may be insufficient to affect the major thickness of the shell.

14. The pressure vessel of claim 13 wherein said damage mitigating material comprises a crushable material.

15. The pressure vessel of claim 13 wherein said damage mitigating material comprises a rigid foam material.

16. A system for mitigating potential damage to a generally hollow vessel which is fabricated of filament wound composite material, the vessel including an outer shell within which is integrated a damage mitigating material, with a given thickness of the composite shell being disposed outside the damage mitigating material, said given thickness of the composite shell and the damage mitigating material being deformable upon impact by a given exterior force.

17. The system of claim 16 wherein said damage mitigating material comprises a crushable material.

18. The system of claim 17 wherein said damage mitigating material comprises a rigid foam material.

* * * * *